US009680236B2

(12) United States Patent
Ngo

(10) Patent No.: US 9,680,236 B2
(45) Date of Patent: Jun. 13, 2017

(54) ELECTRICAL CONNECTOR

(71) Applicant: FCI Americas Technology LLC, Carson City, NV (US)

(72) Inventor: Hung Viet Ngo, Austin, TX (US)

(73) Assignee: FCI Americas Technology LLC, Carson City, NV (US)

( * ) Notice: Subject to any disclaimer, the term of this patent is extended or adjusted under 35 U.S.C. 154(b) by 205 days.

(21) Appl. No.: 14/301,565

(22) Filed: Jun. 11, 2014

(65) Prior Publication Data

US 2015/0011127 A1 Jan. 8, 2015

Related U.S. Application Data

(60) Provisional application No. 61/843,830, filed on Jul. 8, 2013.

(51) Int. Cl.

| | |
|---|---|
| ***H01R 4/48*** | (2006.01) |
| ***H01R 12/72*** | (2011.01) |
| ***H01R 13/11*** | (2006.01) |
| *H01R 13/18* | (2006.01) |
| *H01R 13/422* | (2006.01) |

(Continued)

(52) U.S. Cl.

CPC ..... *H01R 4/48* (2013.01); *H01R 12/724* (2013.01); *H01R 13/113* (2013.01); *H01R 13/18* (2013.01); *H01R 13/422* (2013.01); *H01R 13/428* (2013.01); *H01R 25/142* (2013.01); *Y10T 29/49208* (2015.01)

(58) Field of Classification Search

CPC ..... H01R 9/0515; H01R 9/26; H01R 9/2675; H01R 4/48

See application file for complete search history.

(56) References Cited

U.S. PATENT DOCUMENTS

| | | | |
|---|---|---|---|
| 4,400,049 | A | 8/1983 | Schuck |
| 5,431,576 | A | 7/1995 | Matthews |

(Continued)

FOREIGN PATENT DOCUMENTS

| | | |
|---|---|---|
| JP | 2013/509690 | 3/2013 |

OTHER PUBLICATIONS

Extended European Search Report for European Application No. 14823144.2 dated Jan. 30, 2017.

*Primary Examiner* — James Harvey

(74) *Attorney, Agent, or Firm* — Wolf, Greenfield & Sacks, P.C.

(57) ABSTRACT

An electrical connector can include a connector housing including a housing body that can define an opening that is configured to receive a complementary electrically conductive component along a mating direction. The electrical connector can further include at least one contact member that is supported by the connector housing and is configured to contact the complementary electrically conductive component when the complementary electrically conductive component is received in the opening. The at least one contact member can include an arm having a proximate portion, a distal portion, and an intermediate portion between the proximal and distal portions. The intermediate portion can be spaced outward with respect to each of the proximate and distal portions, and the intermediate portion can bear against the retention rib so as to retain the at least one contact member with respect to the connector housing.

27 Claims, 12 Drawing Sheets

(51) Int. Cl.
*H01R 13/428* (2006.01)
*H01R 25/14* (2006.01)

(56) References Cited

U.S. PATENT DOCUMENTS

| | | | | |
|---|---|---|---|---|
| 7,186,121 | B1 | 3/2007 | Costello et al. | |
| 7,581,972 | B2 | 9/2009 | Daamen | |
| 8,388,389 | B2 | 3/2013 | Costello et al. | |
| 2005/0233644 | A1 | 10/2005 | Bogiel et al. | |
| 2009/0142953 | A1 | 6/2009 | Patel et al. | |
| 2012/0094512 | A1 | 4/2012 | Northey | |
| 2013/0012072 | A1* | 1/2013 | Costello | H01R 13/18 439/660 |
| 2013/0109252 | A1* | 5/2013 | Fehling | H01R 11/05 439/862 |
| 2014/0106627 | A1* | 4/2014 | Hoffman | H01R 4/363 439/863 |
| 2014/0158395 | A1* | 6/2014 | Billman | H02G 5/02 174/68.2 |
| 2014/0322970 | A1* | 10/2014 | Binder | H01R 13/629 439/578 |
| 2014/0349529 | A1* | 11/2014 | Flickinger | H01R 4/48 439/834 |
| 2015/0011127 | A1* | 1/2015 | Ngo | H01R 12/724 439/626 |

* cited by examiner

ELECTRICAL CONNECTOR

CROSS REFERENCE TO RELATED APPLICATIONS

This application claims the benefit of U.S. Provisional Patent Application Ser. No. 61/843,830, filed Jul. 8, 2013, the disclosure of which is hereby incorporated by reference as if set forth in its entirety herein.

BACKGROUND

An electrical connector can include a connector housing and an electrical contact assembly at least partially disposed within the connector housing. The electrical contact assembly, and thus the electrical connector, can include a mating end that is configured to mate with a complementary electrically conductive component so as to establish an electrical connection with the complementary electrically conductive component. The complementary electrically conductive component can be configured as a power rail or bus bar for example. During manufacture, some electrical contact assemblies are inserted into a rear end of the connector housing that is opposite the mating end of the electrical connector. It may be undesirable for the electrical contact assemblies to move within the connector housing after manufacture. For example, vibration of the electrical connector can cause the electrical contact assembly to move toward the rear end of the connector housing.

SUMMARY

In accordance with one embodiment, an electrical connector is configured to mate with a complementary electrically conductive component, such as a bus bar or power rail. The electrical connector includes a connector housing including a housing body that defines an opening configured to receive the electrically conductive component along a mating direction. The electrical connector further includes a retention rib that is supported by the connector housing, and at least one contact member that is supported by the connector housing and is configured to contact the electrically conductive component when the complementary electrically conductive component is received in the opening. The at least one contact member can include an arm having a proximate portion, a distal portion, and an intermediate portion between the proximal and distal portions. The intermediate portion can be spaced outward with respect to each of the proximate and distal portions, and the intermediate portion can bear against the retention rib so as to retain the at least one contact member with respect to the connector housing.

In accordance with another embodiment, an electrical connector is configured to mate with at least one complementary electrically conductive component. The electrical connector is further configured to mount to a substrate. The electrical connector includes a connector housing including a housing body that defines a front end, an opening disposed at the front end, a top end that extends from the front end to a rear end that is spaced from the front end along a longitudinal direction, and a bottom end spaced from the front end along a transverse direction that is substantially perpendicular with respect to the longitudinal direction. The bottom end can define a mounting interface. The electrical connector can further include at least one at least one contact member supported by the connector housing. The at least one contact member can include a contact body that defines a mounting tail that is placed in electrical communication with the substrate when the at least one contact member is mounted to the substrate. The contact body can further define a mating end that electrically contacts the complementary electrically conductive component when the complementary electrically conductive component is received in the opening. At least one of the connector housing and the at least one contact member can define a mounting force transfer interface defined at a location where the housing body abuts the at least one contact member. At least a portion of the location can be in alignment with the mounting tail along the transverse direction.

DETAILED DESCRIPTION

Figure 2:
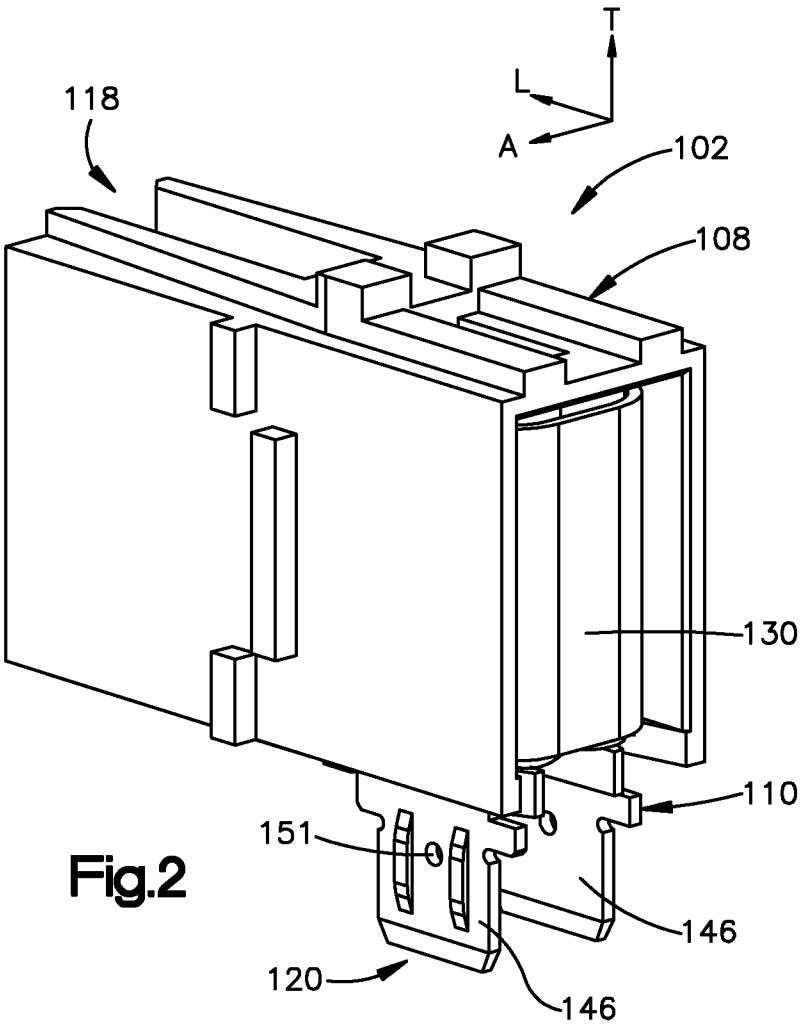
FIG. 2 is a perspective view of the electrical connector shown in FIG. 1 that includes a connector housing and an electrical contact assembly that is at least partially disposed within the connector housing.

For convenience, the same or equivalent elements in the various embodiments illustrated in the drawings have been identified with the same reference numerals. Certain terminology is used in the following description for convenience only and is not limiting. The words "left," "right," "front," "rear," "upper," and "lower" designate directions in the drawings to which reference is made. The words "forward," "forwardly," "rearward," "rearwardly," "inner," "inward," "inwardly," "outer," "outward," "outwardly," "upward," "upwardly," "downward," and "downwardly" refer to directions toward and away from, respectively, the geometric center of the object referred to and designated parts thereof. The terminology intended to be non-limiting includes the above-listed words, derivatives thereof and words of similar import.

Figure 1:
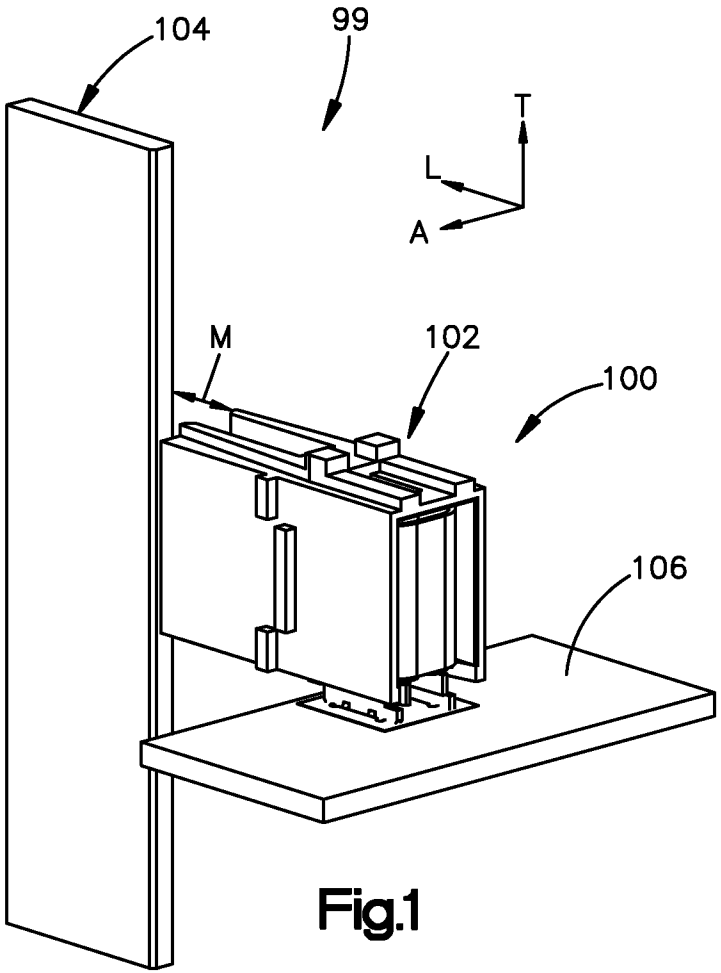
FIG. 1 is a perspective view of an electrical connector system constructed in accordance with one embodiment including an electrical connector mounted to an underlying substrate.

Referring initially to FIG. 1, in accordance with one embodiment, an electrical connector system 99 can include an electrical connector 102, a complementary electrically conductive component 104 that is configured to be placed in electrical communication with the electrical connector 102, and a substrate 106 that also is configured to be placed in electrical communication with the electrical connector 102. Thus, the electrical connector 102 is configured to establish an electrical connection between the substrate 106 and the complementary electrically conductive component 104. For example, the electrical connector 102 can be configured to be mated with at least one complementary electrically conductive component 104, which can be configured as a printed circuit board or an electrical conductor such as a bus bar or power rail. The electrical connector 102 can be mated with the complementary electrically conductive component 104 along a mating direction M so as to establish an electrical connection, for instance an electrical connection that transfers electrical power, between the electrical connector 102 and the electrically conductive component 104, and thus between the substrate 106 and the electrically conductive electrical component 104. In one example, the electrical connector 102 can be a power connector and the electrically conductive component 104 can be configured as a bus bar. The electrical connector 102 can be configured to be mounted to the substrate 106 and the complementary electrically conductive component 104 can be configured to be mounted to a substrate so as to establish an electrical connection between the substrate 106 and the substrate to which the complementary electrically conductive component 104 is mounted. The substrate 106 can be provided as a backplane, midplane, daughtercard, or the like.

Referring also to FIGS. 2-10, the electrical connector 102 can include a dielectric or electrically insulative connector housing 108 and an electrical contact assembly 110 that is at least partially disposed within the connector housing 108. The contact assembly 110, and thus the electrical connector 102, can include at least one contact member, for instance a first contact member 112 and a second contact member 114, that is configured to transmit electrical current. In accordance with the illustrated embodiment, when the electrical connector 102 is mounted to the substrate 106 along a mounting direction, the first and second contact members 112 and 114, respectively, are placed in electrical communication with electrical traces of the substrate 106. Further, when the electrical connector 102 is mated with the electrically conductive component 104 along a mating direction M, the first and second contact members 112 and 114, respectively, are placed in electrical communication with the electrically conductive component 104. While the illustrated embodiment includes the first and second contact members 112 and 114, respectively, it will be understood that the electrical connector 102 can include only one contact member of the first and second contact members or other numbers of contact members as desired. For instance, the first and second contact member 112 and 114 can be monolithic with each other so as to define a single contact member.

Figure 3B:
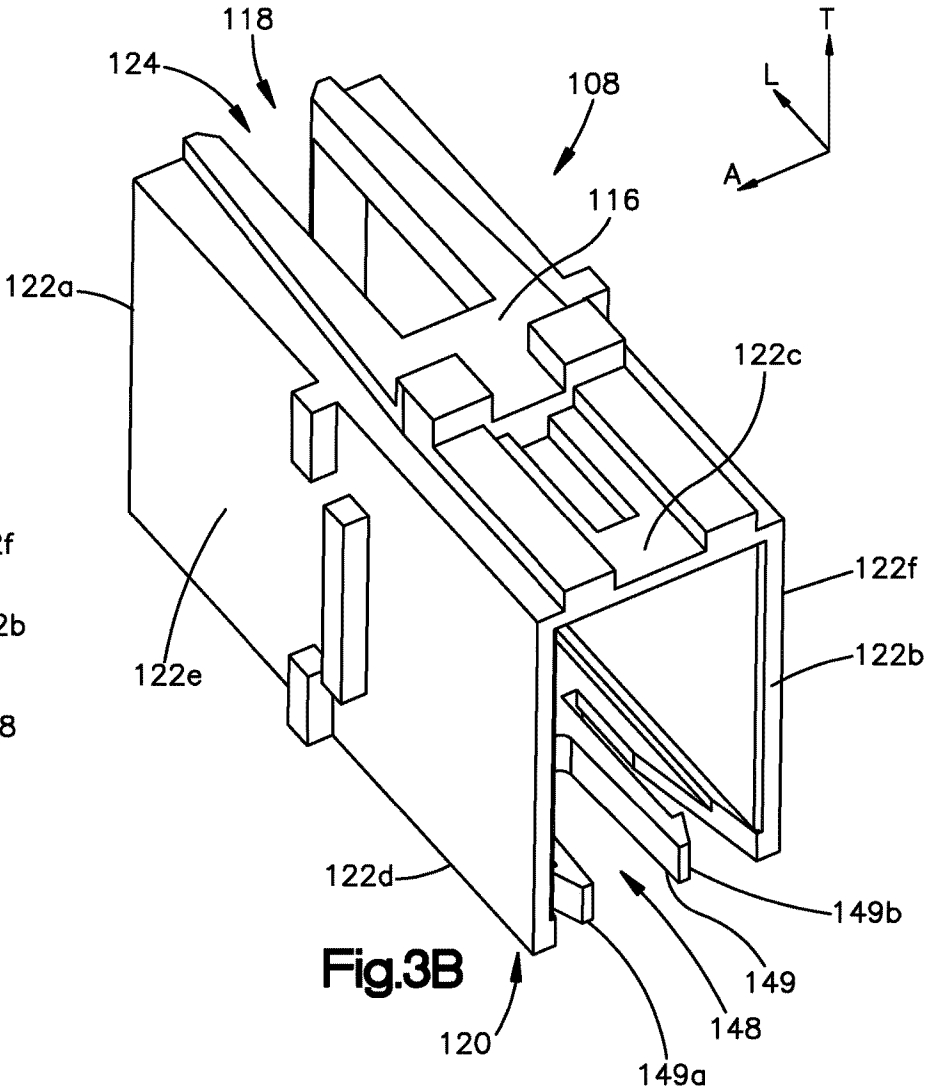
FIGS. 3A-B are perspective views of the connector housing illustrated in FIG. 2.
Figure 3A:
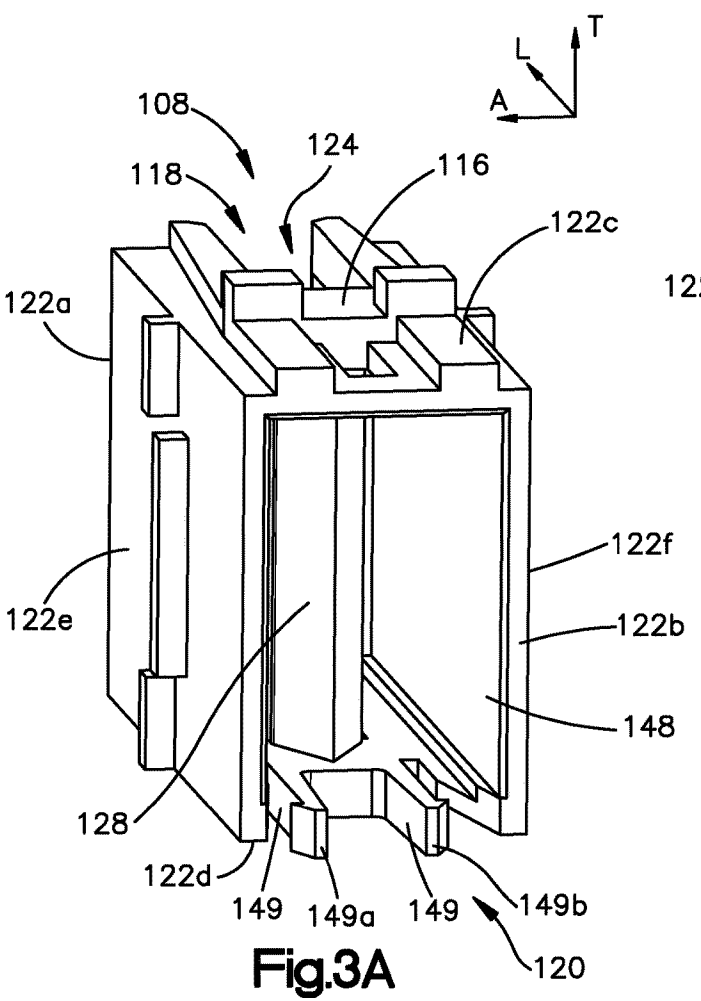

With particular reference to FIGS. 3A-B, in accordance with the illustrated embodiment, the electrical connector 102 is constructed as a right-angle receptacle connector that includes the connector housing 108. The connector housing 108 includes a housing body 116 that defines a mating interface 118 and a mounting interface 120 which are oriented substantially perpendicular with respect to each other so as to define a right-angle electrical connector 102. It will be understood that the electrical connector 102 can be constructed as desired, for instance as a vertical connector such that the mating interface 118 is parallel to the mounting interface 120. The mating interface 118 can be configured to be mated with a complementary electrical component, for instance the electrically conductive component 104, and the mounting interface 120 can be configured to be mounted onto an electrical component, for instance the substrate 106. As shown in the illustrated embodiment, the electrical connector 102 can be configured as a receptacle such that the connector housing 108 is configured to receive the electrically conductive component 104 so as to mate the electrical connector 102 with the complementary electrical component.

Various structures are described herein as extending horizontally along a first or longitudinal direction "L" and a second or lateral direction "A" that is substantially perpendicular to the longitudinal direction L, and vertically along a third or transverse direction "T" that is substantially perpendicular to the longitudinal and lateral directions L and A, respectively. As illustrated, the longitudinal direction "L" extends along a forward/rearward direction of the electrical connector 102, and defines the mating direction M along which one or both of the electrical connector 102 and the electrically conductive component 104 are moved relative to the other so as to mate the electrical connector assembly 102 with the complementary electrically conductive component 104, and thus to mate the electrical connector 102 with the electrically conductive component 104. For instance, the mating direction M of the illustrated electrical connector 102 is in a forward direction along the longitudinal direction L, and the electrical connector 102 can be unmated from the complementary electrically conductive component by moving the electrical connector in an opposed longitudinally rearward direction relative to the complementary electrically conductive component. As illustrated, the electrical connector 102 can be moved relative to the substrate 106 along the transverse direction T that defines the mounting direction, and the lateral direction "A" extends along a width of the electrical connector 102.

Thus, unless otherwise specified herein, the terms "lateral," "longitudinal and "transverse" are used to describe the orthogonal directional components of various components. The terms "inboard" and "inner," and "outboard" and "outer" and like terms when used with respect to a specified directional component are intended to refer to directions along the directional component toward and away from the center of the apparatus being described. It should be appreciated that while the longitudinal and lateral directions are illustrated as extending along a horizontal plane and that while the transverse direction is illustrated as extending along a vertical plane, the planes that encompass the various directions may differ during use, depending, for instance, on the orientation of the various components. Accordingly, the directional terms "vertical" and "horizontal" are used to describe the electrical connector system 99 and its components as illustrated merely for the purposes of clarity and convenience, it being appreciated that these orientations may change during use.

With continuing reference to FIGS. 3A-B, in accordance with the illustrated embodiment, the housing body 116, and thus the connector housing 108, defines a front end 122*a* and an opposed rear end 122*b* that is spaced from the front end 122*a* along the longitudinal direction L. The front end 122*a* can generally lie in a plane defined by the transverse and lateral directions T and A, respectively. The front end 122*a* can define the mating interface 118 that is configured to be mated with the electrically conductive component 104 as to place the electrical connector 102 in electrical communication with the complementary electrically conductive component 104. The housing body 116, and thus the connector housing 108, can further include a top end 122*c* and an opposed bottom end 122*d* that is spaced from the top end 122*c* along the transverse direction T. For instance, the top end 122*c* can be spaced from the bottom end 122*d* in an upward direction that is substantially parallel to the transverse direction T. The top end 122*c* can extend from the front end 122*a* to the rear end 122*b*. The bottom end 122*d* can define the mounting interface 120 that is configured to be mounted to the substrate 106. The bottom end 122*d* can generally lie in a plane defined by the longitudinal and lateral directions L and A, respectively. The connector housing 108, and thus the electrical connector 102, can further include first and second opposed sides 122*e* and 122*f*, respectively, that are spaced from each other along the lateral direction A. While the lateral and longitudinal directions A and L, respectively, extend horizontally and the transverse direction T extends vertically in accordance with the illustrated orientation of the electrical connector system 99, it should be appreciated that the orientation of the electrical connector system can vary as desired.

The housing body 116, and thus the connector housing 108, can define an opening 124 that is configured to receive at least one electrically conductive component along the longitudinal direction L, which can be referred to as the mating direction M. The opening 124 can be disposed at the front end 122*a*. The first contact member 112 can be supported by the connector housing 108 and can be configured to contact the electrically conductive component 104 when the electrically conductive component 104 is received in the opening 124. Further, the illustrated electrical connector 102 includes the second contact member 114 that is spaced from the first contact member 112 along the lateral direction A. The second contact member 114 can be supported by the connector housing 108 and can be configured to contact the electrically conductive component 104 when the electrically conductive component 104 is received in the opening 124. In accordance with the illustrated embodiment, the opening 124 is disposed at the front end 122*a* of the connector housing, thus the front end 122*a* of the connector housing can define the opening 124. The opening 124 can extend between the top end 122*c* and the bottom end 122*d* of the connector housing 108 along the transverse direction T. Thus the top end 122*c* and the bottom end 122*d* can further define the opening 124. The opening 124 can define an opening width 126 (see FIG. 8) along the lateral direction A that is greater than a width of the electrically conductive component 104 such that the electrically conductive component 104 can be received in the opening 124 along the mating direction M.

The housing body 116 further defines an interior void 148 that can be configured to receive the electrical contact assembly 110. Thus, the interior void 148 can be configured to receive at least one contact member, for instance the first and second contact members 112 and 114, respectively. The connector housing 108 can define a pair of cantilevered arms 149 that each define a respective barb 149*a* and 149*b*. The cantilevered arms 149 can extend from the housing body 116 rearwardly along the longitudinal direction L. The barbs 149*a* and 149*b* can be configured to snap behind the first contact member 112 and the second contact member 114, respectively, to help retain the first contact member 112 and the second contact member 114 in the connector housing 108 after the electrical contact assembly 110 is inserted into the connector housing 108. Thus, the barbs 149*a* and 149*b* can be disposed at the rear end 122*b* of the connector housing 108. In accordance with the illustrated embodiment, the cantilevered arms 149 can be disposed at the bottom end 122*d*, although it will be understood that the location of the cantilevered arms can vary as desired. Further, while the illustrated connector housing 108 includes two cantilevered arms 149, each including the respective barb 149*a* and 149*b*, it will be understood that the number of cantilevered arms and the number of barbs defined by each cantilevered arm can vary as desired.

With particular reference to FIG. 3A, the connector housing 108, and thus the electrical connector 102, can include a retention rib 128 that is supported by the housing body 116. It will be understood that the retention rib 128 can be monolithic with the housing body 116 or attached to the housing body 116 as desired. The retention rib 128 can extend between the top end 122*c* and the bottom end 122*d* along the transverse direction T. For instance, the retention rib 128 can connect to the top end 122*c* and the bottom end 122*d*. Alternatively, the retention rib 128 can connect to only one of the top end 122*c* or the bottom end 122*d* as desired. It will also be understood that the retention rib 128 can alternatively be constructed so as to connect to neither the top end 122*c* or the bottom end 122*d*.

Figure 9:
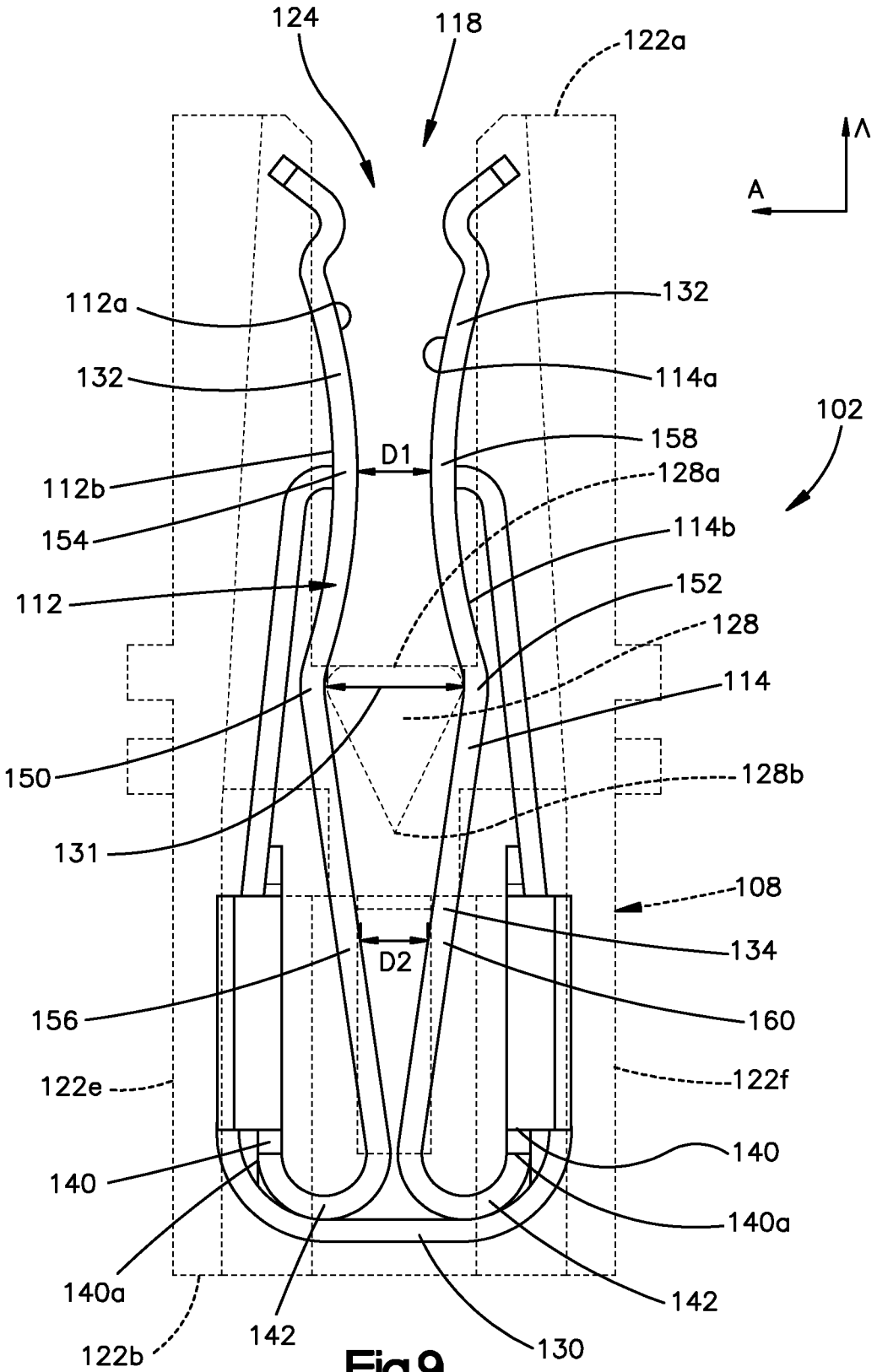
FIG. 9 is a cross-section of the top plan view of FIG. 8, showing the electrical connector illustrated in FIG. 2.

Referring to FIG. 9, the retention rib 128 defines a retention rib width along the lateral direction A. The retention rib 128 can define a front end 128*a* disposed at the mating interface 118 and a rear end 128*b* that is spaced from the front end along the longitudinal direction L. Thus, in accordance with the illustrated embodiment, the opening 124 can be further defined by the retention rib 128, and in particular the front end 128*a* of the retention rib 128. The retention rib 128 can further define a maximum retention rib width 131 along the lateral direction A that is located at the front end 128*a*. The illustrated retention rib 128 has a minimum width along the lateral direction A at the rear end 128*b*. Thus, the width of the illustrated retention rib 128 increases forwardly along the longitudinal direction L, and thus increases along a direction which can be referred to as a forward direction. Thus, the retention rib 128 can be tapered rearwardly along the longitudinal direction L. Further, the width of the retention rib 128 can increase in the forward direction such that a cross-section of the retention rib 128 is substantially triangular when viewed along the transverse direction T, although it will be understood that the retention rib 128 can be alternatively shaped as desired.

Referring to FIGS. 4-7, the electrical contact assembly 110, and thus the electrical connector 102, can further include a bias member 130 that engages at least one contact member, for instance the first contact member 112, and biases the first contact member in the lateral direction A that is perpendicular to the mating direction M. The bias member 130 can further engage the second contact member 114 and bias the second contact member in the lateral direction A such that the bias member retains the first and second contact members 112 and 114, respectively, in position relative to each other. The illustrated bias member 130 is substantially C-shaped, although it will be understood that the bias member 130 can be alternatively shaped as desired. In accordance with the illustrated embodiment, the bias member defines a bias member body 166 and first and second beams 168 and 170 that extend from the bias member body 166 along the longitudinal direction L. The bias member body 166 can extend between rear locations of the first and second beams 168 and 170 along the lateral direction A. The first and second beams 168 and 170 can converge toward each other along the forward longitudinal direction L. Thus, the first and second beams 168 and 170 and the bias member body 166 can define a recess 172 that can be configured to receive at least a portion of the first and second contact members 112 and 114. Further, the first and second beams 168 and 170 can be configured to resiliently flex away from each other, for instance to receive the first and contact members 112 and 114. The bias member 130 can be constructed so as to be electrically conductive. While the illustrated electrical contact assembly 110 includes the first and second contact members 112 and 114, respectively, it will be understood that the electrical contact assembly 110 can be constructed so as to include a single contact member as desired.

Figure 4:
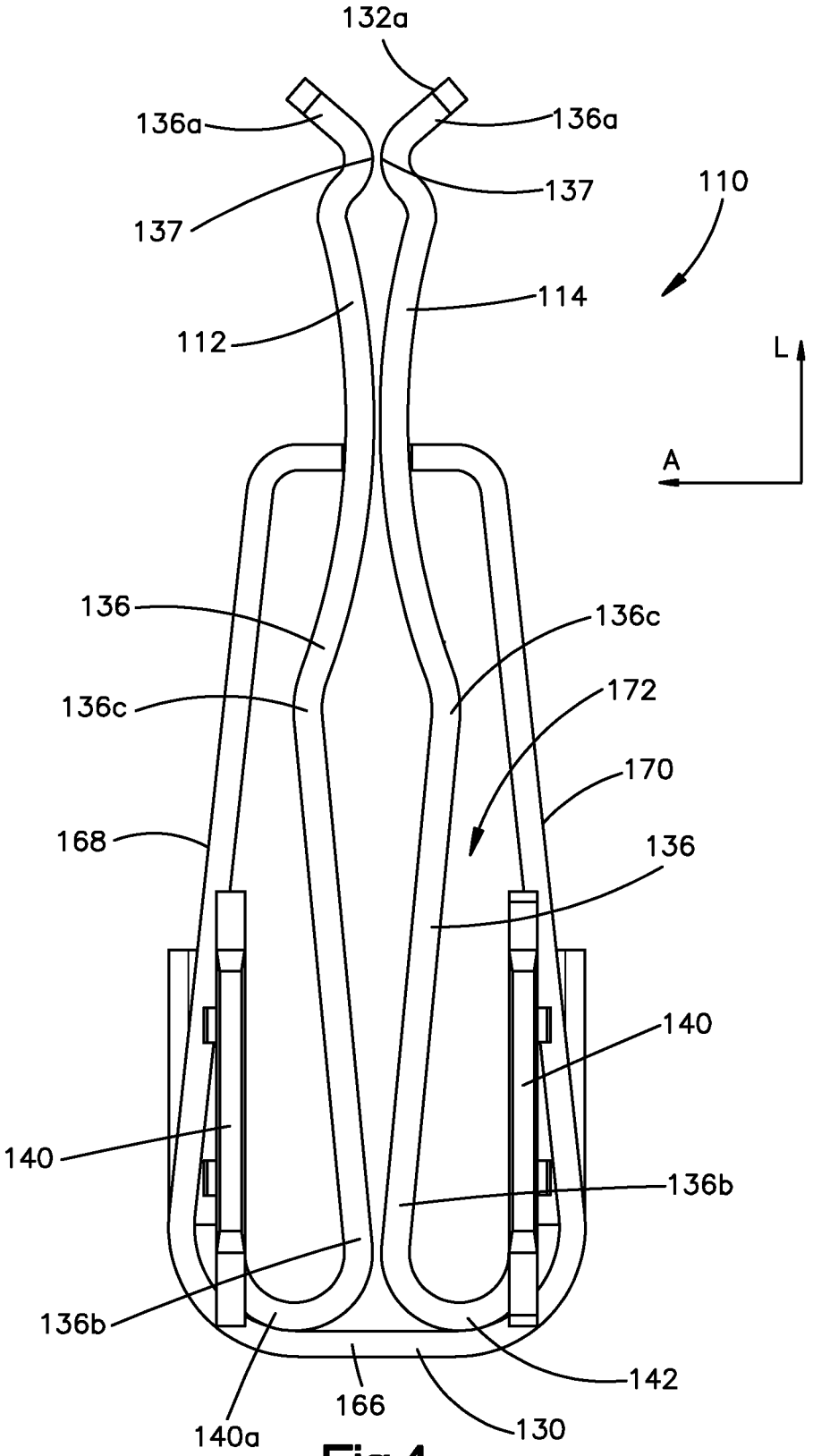
FIG. 4 is a top plan view of the electrical contact assembly of the electrical connector illustrated in FIG. 2, wherein the electrical contact assembly includes a bias member, a first contact member, and a second contact member.
Figure 5:
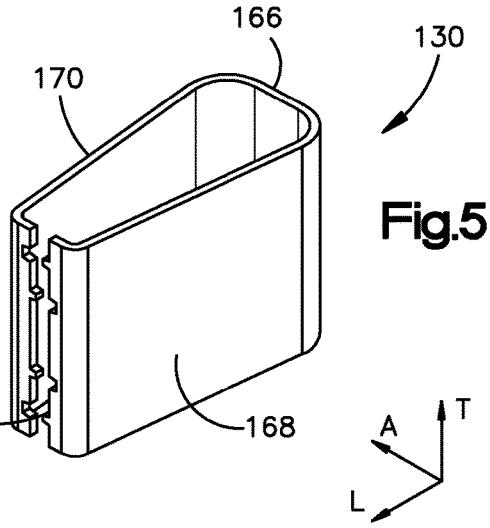
FIG. 5 is a perspective view of the bias member of the electrical contact assembly illustrated in FIG. 4.

The first contact member 112 can include a first contact body 132 including a first intermediate portion 142, a first end portion 140 that extends forward along the mating direction M from the first intermediate portion 142, and a first arm 136 that extends forward along the mating direction M from the first intermediate portion 142 and that is spaced from the first end portion 140 along the lateral direction A. For instance, the first arm 136 can be disposed laterally inward with respect to the first end portion 140. The first arm 136 can include an arm body 134 and a plurality of first fingers 138 that extend forward from the first arm body 134 along the longitudinal direction, and thus extend in a forward direction. Thus, the first fingers 138 can be cantilevered with respect to the first arm body 134, and the first arm body 134 can be disposed between, and connected between, the first intermediate portion 142 and the first fingers 138. The first fingers 138 can be spaced from each other along the transverse direction T. Referring particularly to FIG. 4, the first arm 136 can have a first distal portion 136*a*, a first proximal portion 136*b*, and a first intermediate portion 136*c* that is disposed between the proximal and distal portions 136*b* and 136*a*, respectively. The first intermediate portion 136*c* can be spaced outwardly with respect to each of the first proximal and distal portions 136*b* and 136*a*, respectively, and the first intermediate portion 136*c* can bear against the retention rib 128 so as to retain the first contact member 112 with respect to the connector housing 108.

The second contact member 114 can include a second contact body 132 including a second intermediate portion 142, a second end portion 140 that extends forward along the mating direction M from the second intermediate portion 142, and a second arm 136 that extends forward along the mating direction M from the second intermediate portion 142 and that is spaced from the second end portion 140 along the lateral direction A. For instance, the second arm 136 can be disposed laterally inward with respect to the second end portion 140. The second arm 136 can include an arm body 134 and a plurality of second fingers 138 that extend forward from the second arm body 134 along the mating direction M, and thus extend in the forward direction. Thus, the second fingers 138 can be cantilevered with respect to the second arm body 134, and the second arm body 134 can be disposed between, and connected between, the second intermediate portion 142 and the second fingers 138. The second fingers 138 can be spaced from each other along the transverse direction T. The second arm 136 can have a second distal portion 136*a*, a second proximal portion 136*b*, and a second intermediate portion 136*c* that is disposed between the proximal and distal portions 136*b* and 136*a*, respectively. The second intermediate portion 136*c* can be spaced outwardly with respect to each of the second proximal and distal portions 136*b* and 136*a*, respectively, and the second intermediate portion 136*c* can bear against the retention rib 128 so as to retain the second contact member 114 with respect to the connector housing 108.

In accordance with the illustrated embodiment, the first arm 136 of the first contact member 112 is opposite the arm 136 of the second contact member 114 along the lateral direction A to define opposed arms 136 that are configured to abut opposed sides of the electrically conductive component 104 when the electrically conductive component 104 is received in the opening 124. It will be understood that the first and second contact members can be monolithic with each other so as to define a single contact member having the first and second arms 136. While each of the illustrated first and second contact members 112 and 114, respectively, include six fingers 138, it will be understood that the number of fingers 138 can vary as desired. Further, while the illustrated fingers 138 are substantially the same size as each other and are substantially recut angularly shaped, it will be understood that the size of the fingers with respect to each other can vary and the fingers 138 can be alternatively shaped as desired. The fingers 138 can define contact surfaces 137 that are disposed laterally inward with respect to the arm bodies 134. The contact surfaces 137 can be disposed at the distal portion 136*a* such that they can be configured to abut opposed sides of the electrically conductive component when the electrically conductive component is received in the opening 124.

The contact bodies 132 can define a mating end 132*a* that is disposed at the front of the respective contact members along the longitudinal direction L. The mating end 132*a* can electrically contact the complementary electrically conductive component 104 when the complementary electrically conductive component 104 is received in the opening 124. It will be understood that the first and second contact members 112 and 114 can be monolithic with each other so as to define a single contact member. Thus, at least one contact member can include the first and second arms 136 that can cooperate so as to define the mating end 132*a*, and each of the first and second arms 136 can frictionally bear against the retention rib 128 so as to retain the at least one contact member with respect to the connector housing 108 such that the mating end 132*a* receives and contacts the electrically conductive component 104 when the electrically conductive component 104 is received in the opening 124. Thus, the mating end 132*a* can be adjacent to the complementary electrically conductive component 104 along the lateral direction A that is perpendicular to both the longitudinal and the transverse directions L and T, respectively.

Referring to FIGS. 4-7 and 9, in accordance with the illustrated embodiment, each of the first and second contact members 112 and 114, respectively, of the contact assembly 110 can further include the end portion 140 that is configured to electrically connect to the substrate 106 and an intermediate portion 142 that extends between the end portion 140 and the arm 136 such that the end portion 140 is spaced outwardly from the arm 136 along the lateral direction A. Thus, the intermediate portion 142 can be configured to transmit electrical current between the end portion 140 and the arm 136, and the arm 136 can be configured to transmit electrical current between the intermediate portion 142 and the mating end 132*a*. In accordance with the illustrated embodiment, the first contact member 112 includes the first intermediate portion 142 that abuts the bias member 130 and the second contact member 114 includes the second intermediate portion 142 that abuts the bias member 130. As shown, the end portions 140 can abut the bias member 130. Thus, the first contact body 132, and thus the first contact member 112 can define an interior surface 112*a* and an opposed exterior surface 112*b*, and the bias member 130 can contact the opposed exterior surface 112*b* of the first contact body 132. Similarly, the second contact body 132, and thus the second contact member 114, can define an interior surface 114*a* and an opposed exterior surface 114*b*, and the bias member 130 can contact the opposed exterior surface 114*b* of the second contact body 132. The intermediate portions 142 can connect to the end portions 140 at a mounting end 140*a* that is spaced from the mating end 132*a* along the longitudinal direction L. Although the illustrated intermediate portions 142 are curved, it will be understood that the intermediate portions 142 can be alternatively shaped as desired.

Figure 11:
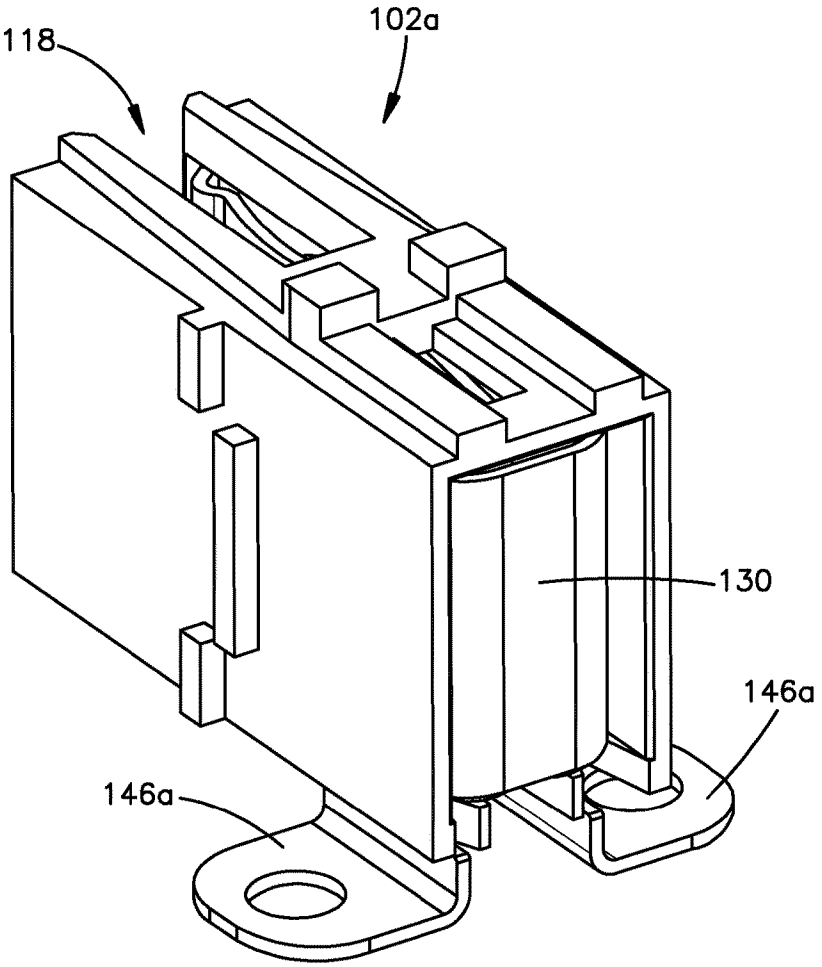
FIG. 11 is an electrical connector constructed in accordance with another embodiment.

At least one contact member, for instance the first and second contact members 112 and 114, can define mounting tails 146 that are configured to be mounted to the substrate 106. For instance, the contact body 132 can define the mounting tails 146 that are placed in electrical communication with the substrate 106 when at least one contact member is mounted to the substrate 106. The end portion 140 can include an end portion body 144 and the mounting tails 146 that are disposed proximate to the mounting interface 120. The mounting tails 146 can extend from the end portion body 144 downwardly along the transverse direction T. In accordance with the illustrated embodiment shown in FIG. 2, the electrical connector 102 includes two mounting tails 146, and one mounting tail 146 extends from each end portion body 144, although it will be understood that the number of mounting tails 146 can vary as desired. The mounting tails 146 that extend from the end portion bodies 144 can be configured to be mounted to the underlying substrate 106 and can be configured to electrically connect to the substrate 106. For instance, the mounting tails 146 can be press-fit solder tails and can be configured to be inserted, or press-fit, into respective vias of the substrate 106, thereby electrically connecting the end portions 140 and the corresponding contact members 112 and 114 to respective electrical traces of the substrate 106 when the electrical connector 102 is mounted to the substrate 106. The mounting tails 146 can be elongate along the transverse direction T. The vias can be configured as plated through-holes that electrically connect the end portions 140 to respective electrical traces of the underlying substrate 106. The mounting tails 146 can define holes 151 such that solder can flow between opposed surfaces of the substrate 106. While the illustrated mounting tails 146 of the contact members shown in FIG. 2 are configured as press-fit tails, it should be appreciated that the mounting tails 146 can be configured to be placed in electrical communication with electrical traces of the substrate 106 in accordance with any suitable alternative embodiment. For instance, in the illustrated embodiment shown in FIG. 11, an electrical connector 102*a* includes mounting tails 146*a* that are configured to be surface mounted and configured to be attached, for instance screwed, to complementary contact pads of a substrate or bus bar.

The electrical contact assembly 110, including the arms 136, the contact bodies 132, the intermediate portions 142, the end portions 140, and the bias member 130, can be made of any suitable electrically conductive material as desired, such as a copper alloy. The electrical contact assembly 110 can be sized to carry electrical communications or data signals, or to support DC and/or AC power.

Referring to FIG. 9, at least one contact member of the electrical connector 102, for instance the first contact member 112, can be frictionally clamped to the retention rib 128 in an area 150 of the first contact member 112. The area 150 of the first contact member can be located between the mating end 132*a* of the first contact member 112 and the mounting end 140*a* of the first contact member 112. In accordance with the illustrated embodiment, the area 150 can be defined by the interior surface 112*a* of the first contact member 112. Further, the electrical connector 102 can include the second contact member 114 that can be frictionally clamped to the retention rib 128 in an area 152 of the second contact member 114 located between the mating end 132*a* of the second contact member 114 and the mounting end 140*a* of the second contact member 114. The area 152 can be defined by the interior surface 114*a* of the second contact member 114.

The electrical connector can include first and second contact members 112 and 114, respectively, that are spaced apart from each other along the lateral direction A. The first contact member can define a first location 154 and a second location 156 that is rearwardly spaced apart from the first location 154 along the longitudinal direction L such that the retention rib 128 is disposed between the first and second locations. Similarly, the second contact member 114 can define a first location 158 and a second location 160 that is rearwardly spaced from the first location 158 along the longitudinal direction L such that the retention rib 128 is disposed between the first and second locations 158 and 160, respectively. The first location 154 of the first contact member 112 can be spaced apart from the first location 158 of the second contact member 114 along the lateral direction A to define a first distance $D_1$ that is less than the maximum retention rib width 131. The second location 156 of the first contact member 112 can be spaced apart from the second location 160 of the second contact member 114 along the lateral direction A to define a second distance $D_2$ that is less than the maximum retention rib width 131. Thus, in accordance with the illustrated embodiment, the first and second contact members 112 and 114 are spaced from each other at first and second locations positioned such that the retention rib 128 is disposed between the first and second locations, and the first and second contact members are spaced from each other at each of the first and second locations a distance along the lateral direction A that is less than the maximum width 131 of the retention rib 128.

Figure 6:
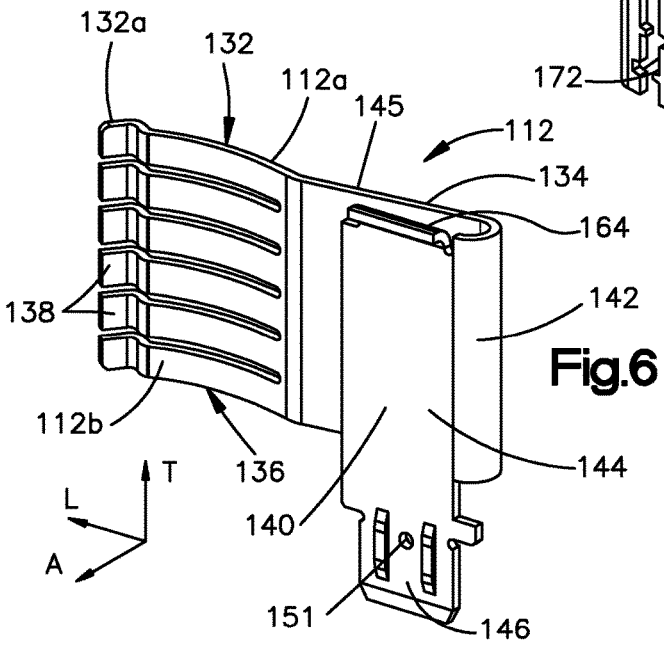
FIG. 6 is a perspective view of the first contact member of the electrical contact assembly illustrated in FIG. 4.
Figure 7:
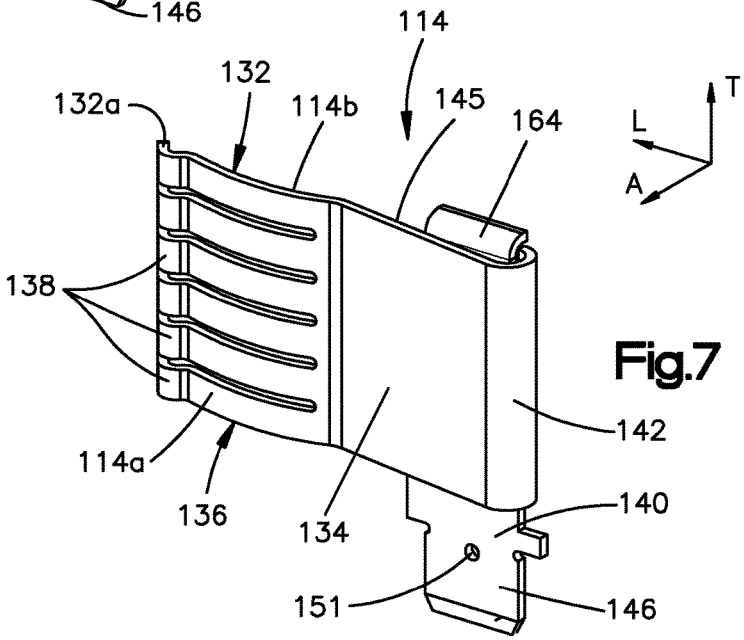
FIG. 7 is a perspective view of the second contact member of the electrical contact assembly illustrated in FIG. 4.
Figure 8:
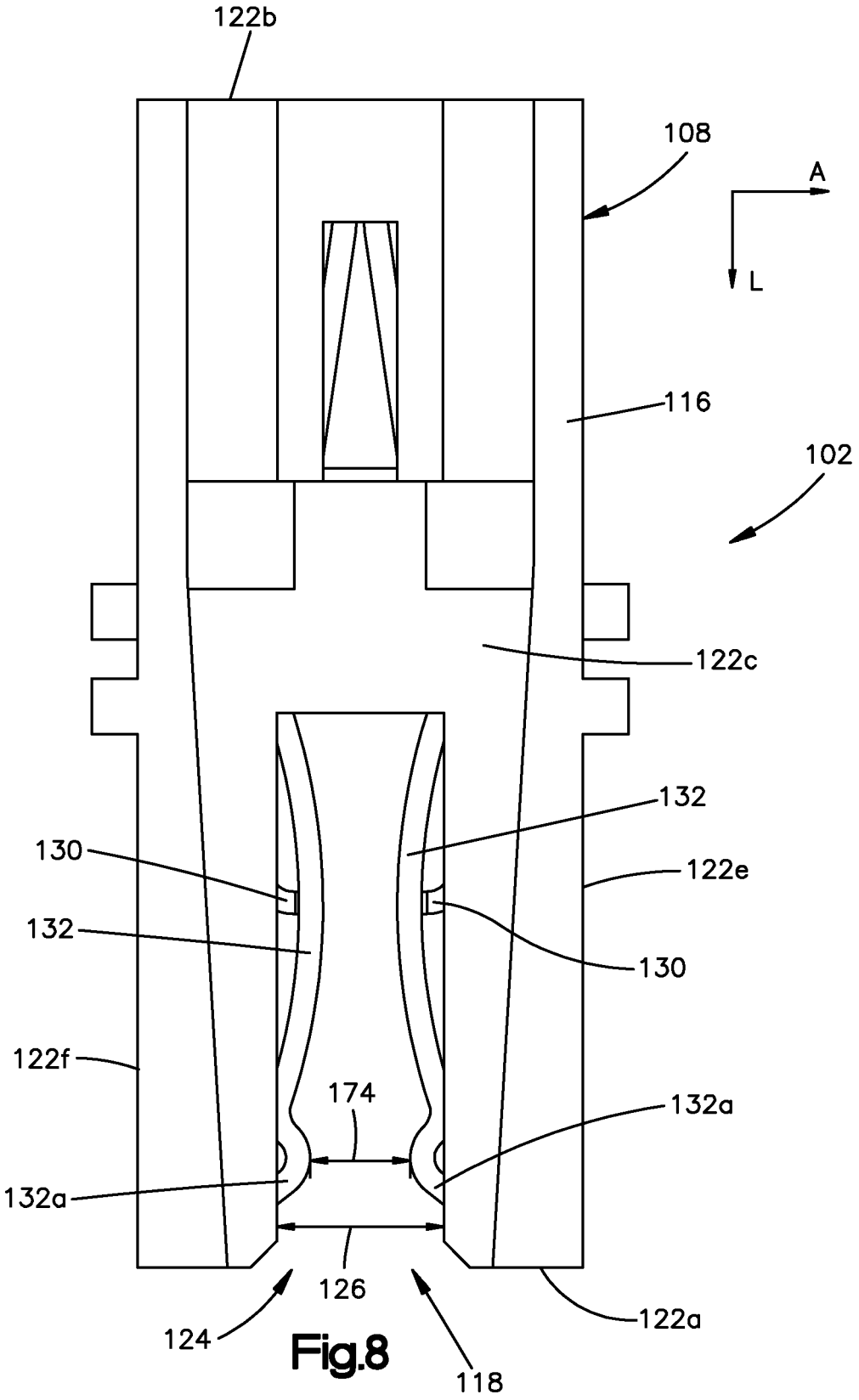
FIG. 8 is a top plan view of the electrical connector illustrated in FIG. 2.
Figure 10:
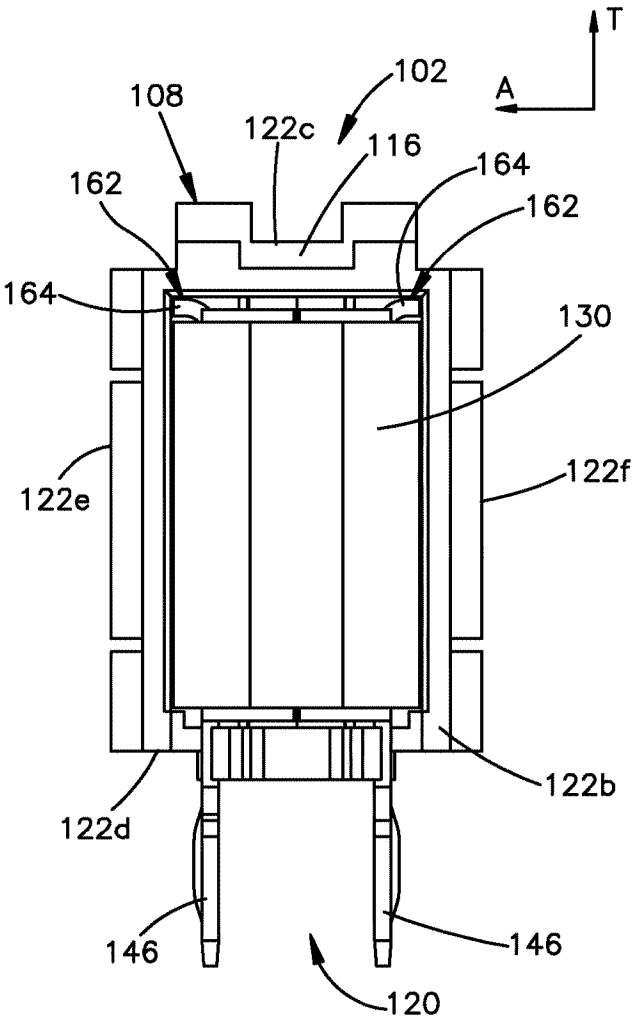
FIG. 10 is a rear elevation view of the electrical connector that is shown in FIG. 2.

Referring to FIGS. 6-7 and 10, the electrical connector 102 can include a mounting transfer interface 162 that can be configured to transfer a downward force along the transverse direction T so that that the mounting tails 146 can be mounted, for instance received in respective vias, to the substrate 106. For instance, at least one of the connector housing 108 and at least one contact member can define the mounting force transfer interface 162 defined at a location where the housing body 116 abuts the at least one contact member, and at least a portion of the location can be in alignment with the mounting tail 146 along the transverse direction T. Further, in one embodiment, the locations that define the mounting transfer interfaces 162 are the only locations where the top end 122*c* of the housing body 116 abuts the electrical contact assembly 110. In accordance with the illustrated embodiment, a first mounting transfer interface 162 can be defined at a first location where the housing body 116 abuts the first contact member 112, and a second mounting transfer interface 162 can be defined at a second location where the housing body 116 abuts the second contact member 114. Though the illustrated electrical connector 102 includes one mounting transfer interface 162 per mounting tail 146, it will be understood that the number of mounting transfer interfaces can vary as desired.

In accordance with the illustrated embodiment, the housing body 116 and the first contact member 112 defines the first mounting force transfer interface 162 that is defined at the first location where the housing body 116 abuts the first contact member 112, and the first location is in alignment with the end portion 140, and in particular the mounting tail 146, of the first contact member 112 along the transverse direction T that is substantially perpendicular to both the mating and lateral directions M and A, respectively. Similarly, the housing body 116 and second contact member 114 can define the second mounting transfer interface 162 that is defined at the second location where the housing body 116 abuts the second contact member 114, and the second location is in alignment with the end portion 140, and in particular the mounting tail 146, of the second contact member 114 along the transverse direction T. Thus, at least one of the contact members can define the mounting force transfer interface 162 defined at least a portion of the location where the housing body 116 abuts the at least one contact member. Further, at least a portion, for instance an entirety, of the location can be in alignment with the mounting tail 146 along the transverse direction T. Although both the illustrated first and second contact members 112 and 114 define the respective mounting transfer interface 162, it will understood that the electrical connector 102 can be constructed such that only one of the contact members 112 and 114 defines the mounting transfer interface 162 as desired.

At least one contact member, for instance each of the first and second contact members 112 and 114, can define the contact body 132 and one or more mounting force transfer members 164 that extend up from the contact body 132 along the transverse direction T. In accordance with the illustrated embodiment, the mounting force transfer members 164 can extend up from the end portion bodies 144 along the transverse direction T. Further, at least one of the contact members, for instance each of the first and second contact members 112 and 114, can define an uppermost surface 145, and the mounting force transfer member 164 can extend up from the uppermost surface 145 along the transverse direction such that the mounting force transfer member 164 terminates at a location spaced from the uppermost surface along the upward direction. The mounting force transfer member 164 can be curved such that the mounting force transfer member 164 terminates at a location that is laterally offset from the uppermost surface 145 from which it extends. Further, the mounting force transfer member 164 can be curved such that at least a portion of the mounting force transfer member 164 can be compressed along the transverse direction T. The mounting force transfer member 164 can be configured to abut the housing body 116, in particular the top end 122*c* of the housing body, to define the mounting force transfer interface 162. In accordance with one embodiment, the mounting force transfer members 164 are the only portions of the electrical contact assembly 110 that abut the top end 122*c* of the housing body.

Alternatively, the housing body 116 can define the interior void 148 that is configured to receive the at least one contact member, for instance each of the first and second contact members 112 and 114, and the connector housing 108 can include a mounting force transfer member that extends from the housing body 116 into the interior void 148 such that the mounting force transfer member is configured to abut at least one contact member to define the mounting force transfer interface. For instance, the mounting force transfer member of the connector housing 108 can extend from the top end 122*c* in a downward direction that is opposite the upward direction and into the interior void 148. Thus, the mounting force transfer member of the housing 108 can be configured to abut the contact body 132 to define the mounting force transfer interface. Alternatively still, the mounting force transfer member of the connector housing 108 can be configured to abut the mounting force transfer member 164 of the at least one contact member, for instance the first and second contact members 112 and 114. It will be understood that the housing body 116 can abut the first and second contact members 112 and 114 at the mounting force transfer interface 162 that can be aligned with the mounting tail 146 along the transverse direction T such that when a downward force is applied along the transverse direction T, for instance to the top end 122*c* of the housing body 116, the force is transferred to the mounting tails 146 so as to mount the mounting tails 146, and thus the electrical connector 102, to the substrate 106.

Figure 12A:
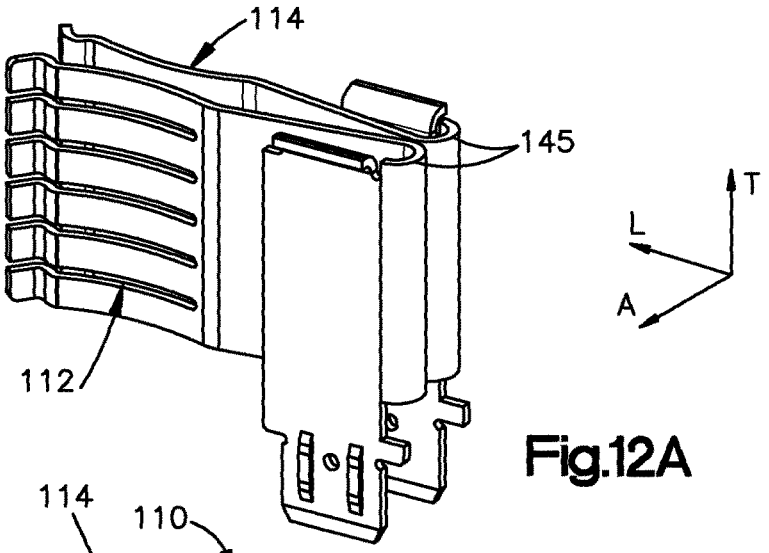
FIG. 12A is a perspective view of the first and second contact members arranged to be retained by the bias member.
Figure 12B:
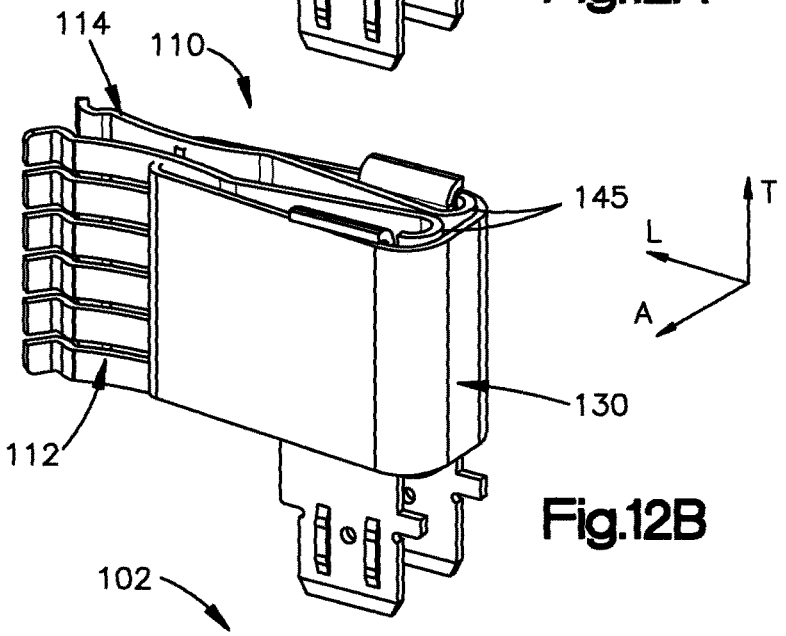
FIG. 12B is a perspective view of the electrical contact assembly that is part of the electrical connector shown in FIG. 2.
Figure 12C:
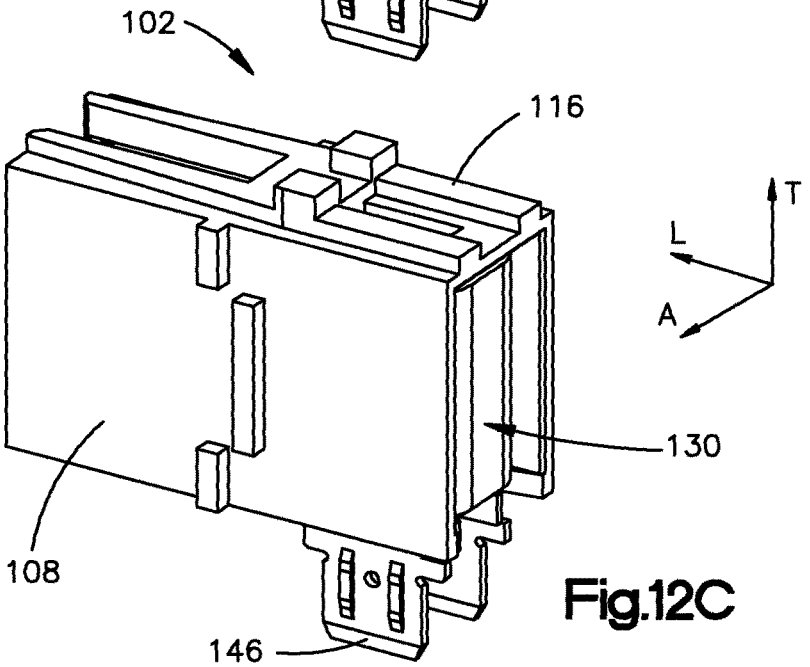
FIG. 12C is another perspective view of the electrical connector that is shown in FIG. 2.
Figure 13:
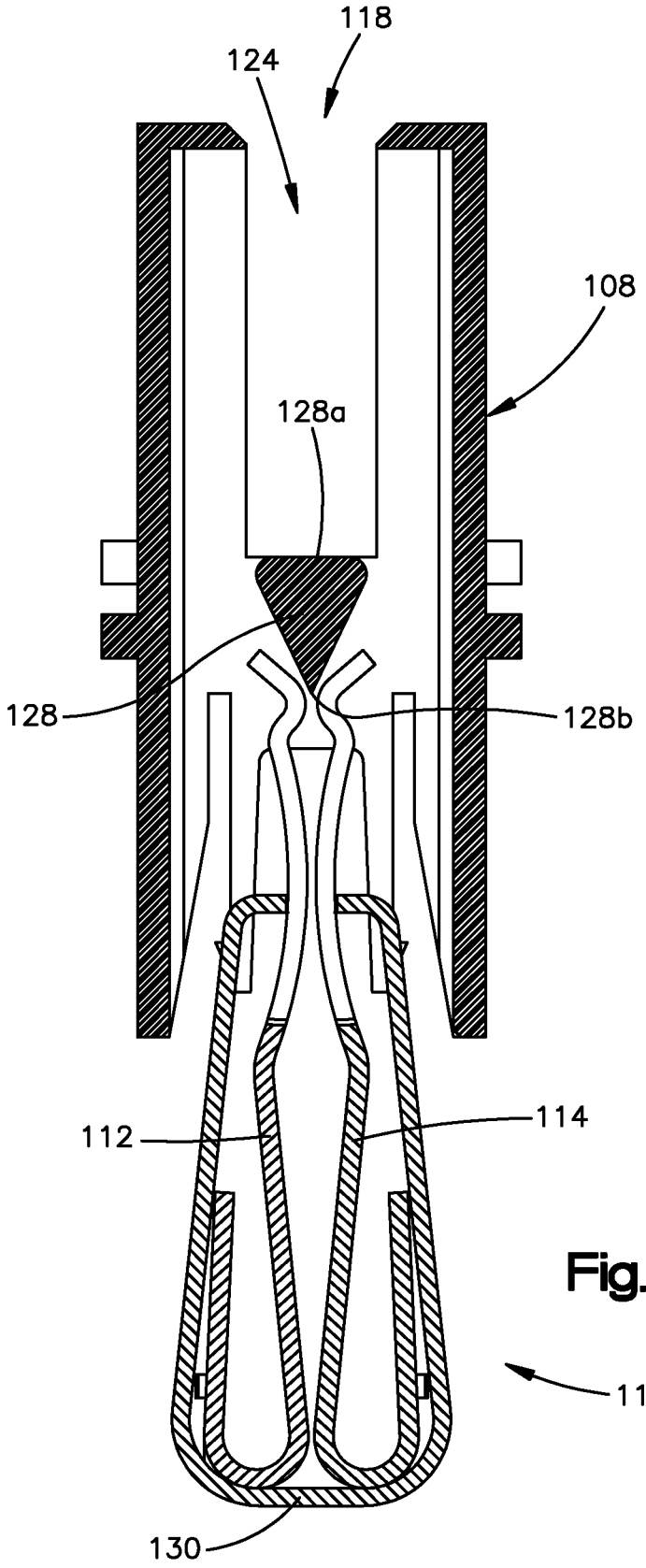
FIG. 13 is a perspective view of the electrical contact assembly partially inserted into the connector housing that is shown in FIG. 3A, wherein the connector housing is illustrated as a cross-section.
Figure 14:
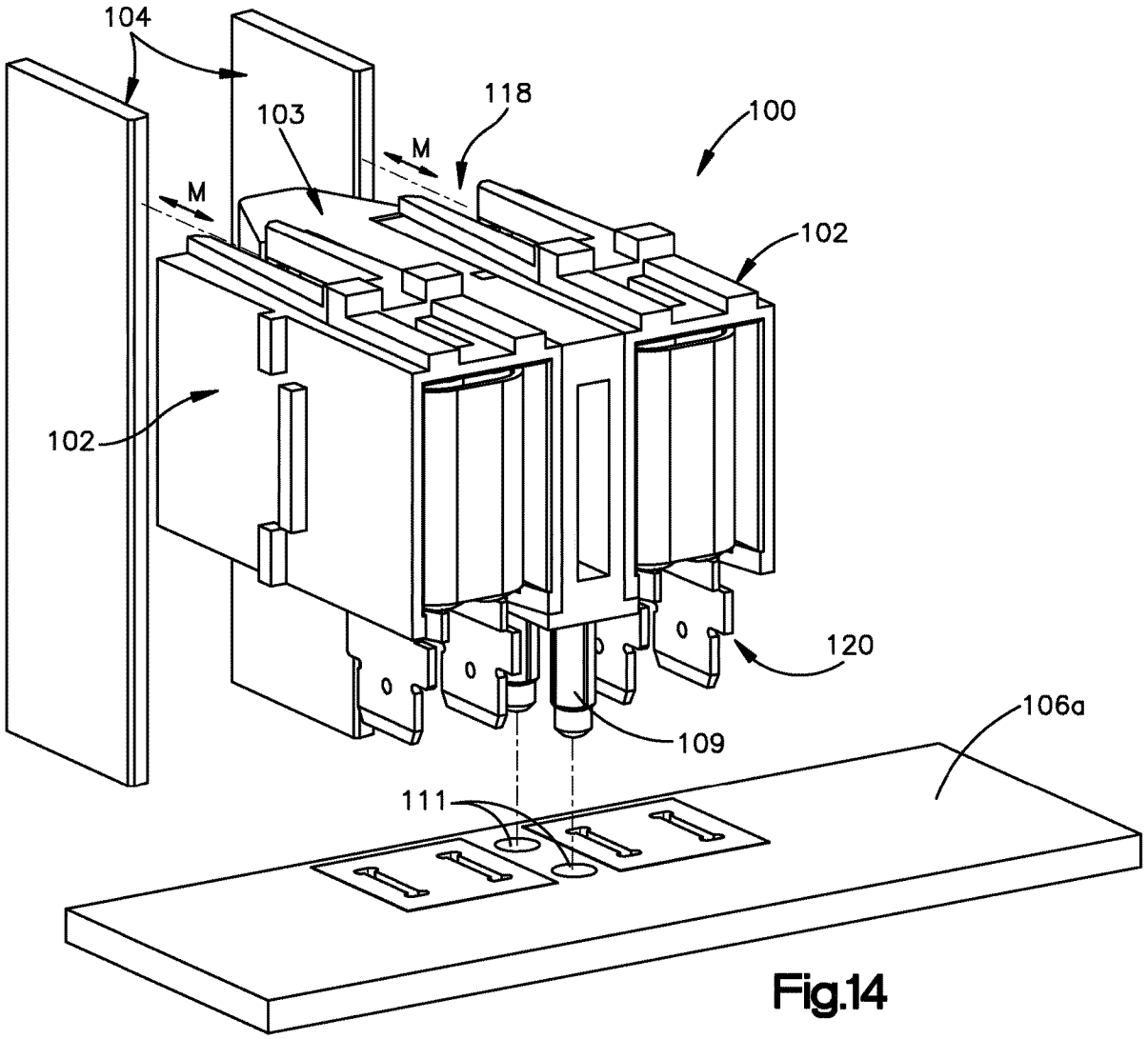
FIG. 14 is a perspective view of an electrical connector assembly that includes two electrical connectors that are depicted in FIG. 2, in accordance with another embodiment.
Figure 15:
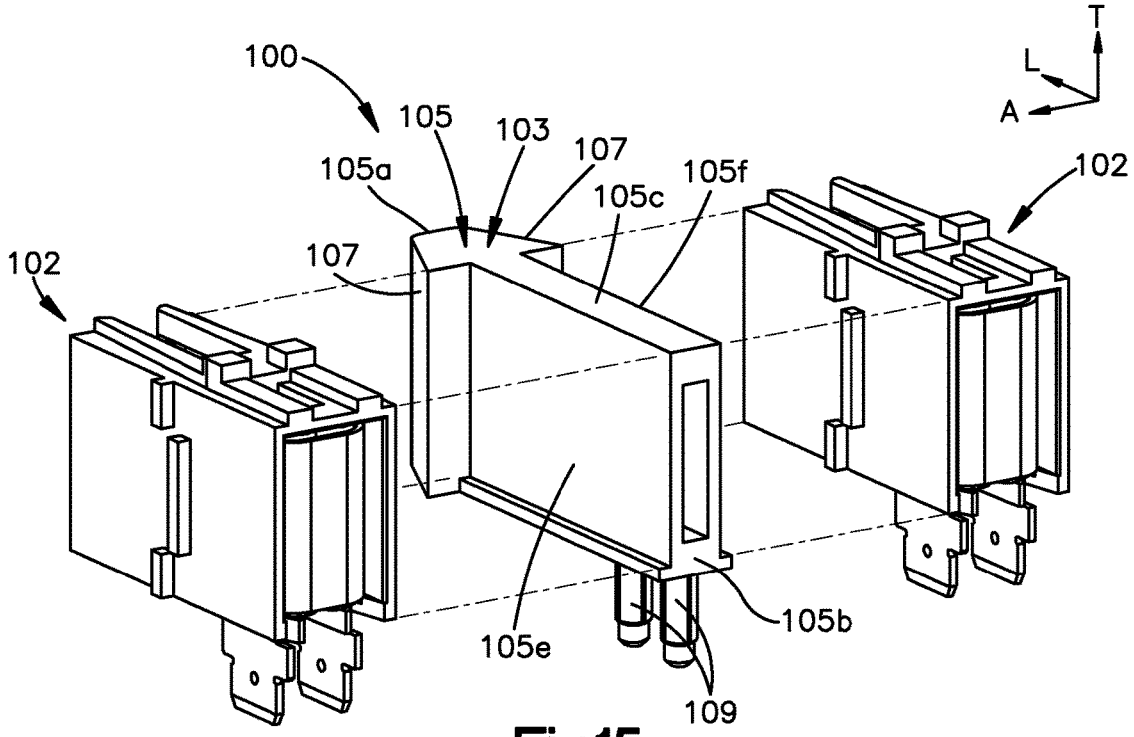
FIG. 15 is an exploded view of the electrical connector assembly shown in FIG. 14 that includes the electrical connectors and a guide member.
Figure 16:
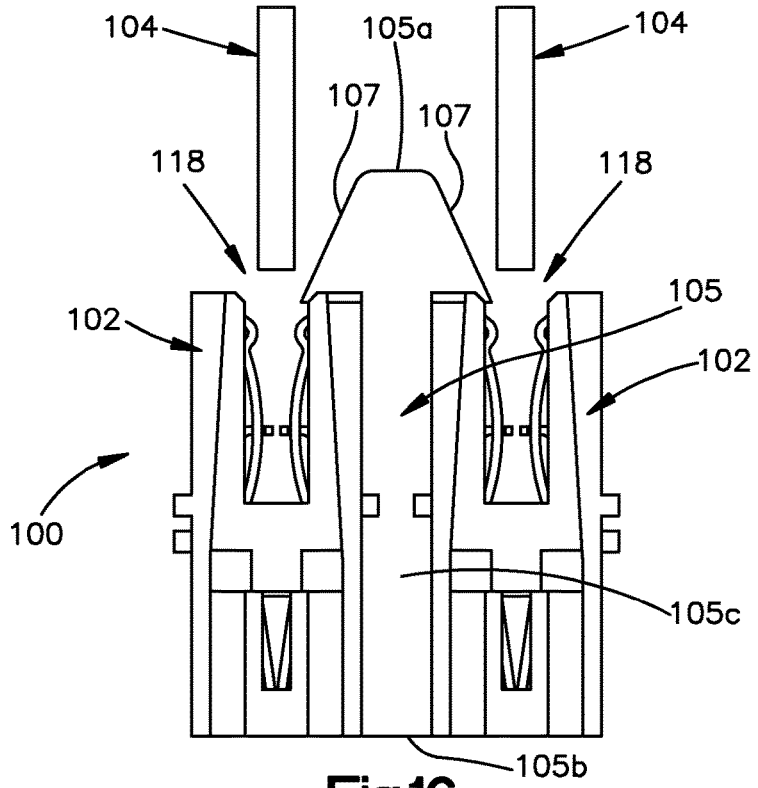
FIG. 16 is a top plan view of the electrical connector assembly shown in FIG. 14.
Figure 17A:
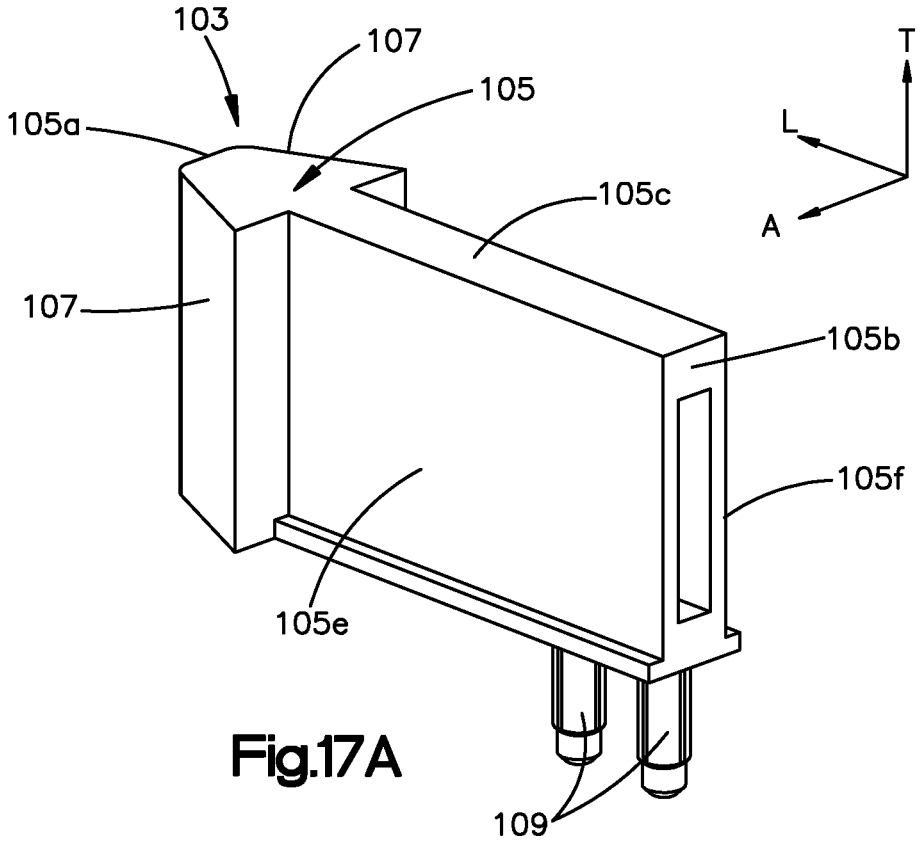
FIGS. 17A and 17B are perspectives view of the guide member of the electrical connector assembly that is shown in FIG. 15.
Figure 17B:
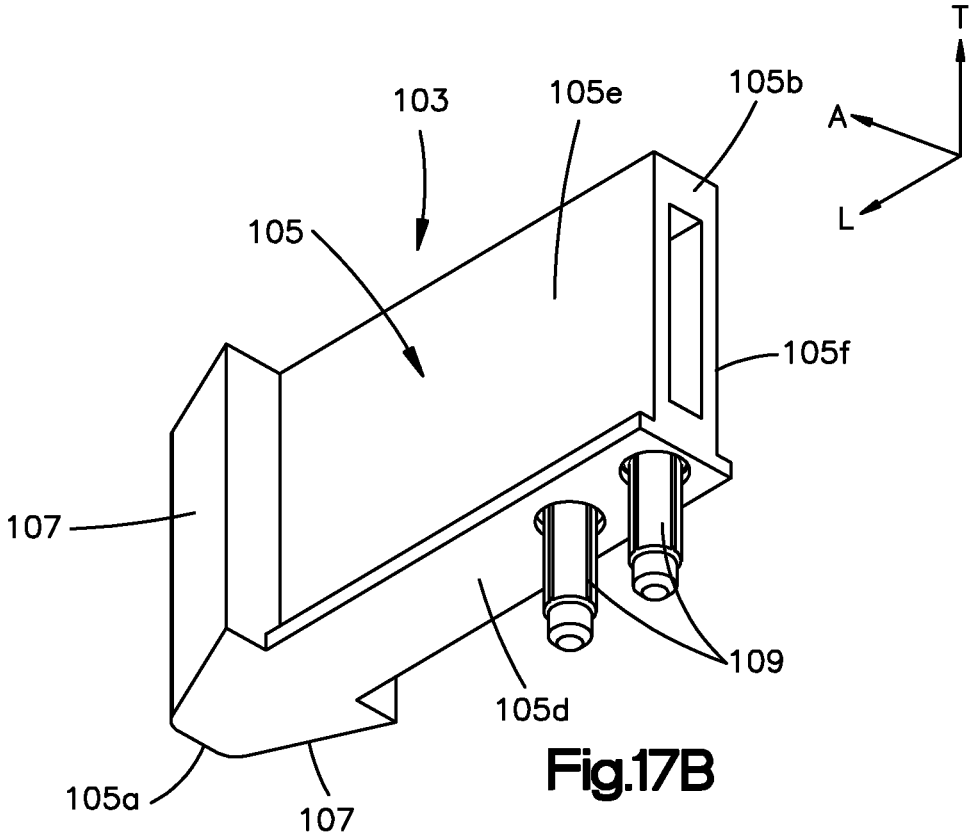

Referring to FIG. 12A, the electrical connector 102 can be constructed by stacking the first contact member 112 against the second contact member 114 so that the first contact member and second contact members 112 and 114 are spaced apart from each other along the lateral direction A. Thus, the first contact member 112 can include fingers 138 that are opposite respective fingers 138 of the second contact member 114 along the lateral direction A. Referring to FIG. 12B, the first and second beams 168 and 170 can be resiliently flexed away from each other to receive portions of the first and second contact members 112 and 114 in the recess 172. The recess 172 can be sized so as to engage the first and second contact members 112 and 114 and bias the first and second contact members in the lateral direction. In accordance with the illustrated embodiment, the mating ends 132*a* of the first and second contact members, and in particular the opposed fingers 138, can converge to define "pinching" or "receptacle" fingers, such that the interior surface 112*a* of the first contact member 112 and the interior surface 114*a* of the second contact member 114 are configured to abut at least a portion of the electrically conductive component 104 so as to place the electrically conductive component 104 in electrical communication with the electrical connector 102 when the electrically conductive component 104 and electrical connector 102 are mated with each other.

Referring to FIGS. 12A-C and 13, the electrical contact assembly 110 can be received in the interior void 148 of the connector housing 108. For instance, the electrical contact assembly 110 can be inserted into the connector housing 108 from the rear end 122*b* toward the front end 122*a* along the longitudinal direction L. As the contact body 132 is inserted into the connector housing 108 along the longitudinal direction L, the contact body 132 can come into contact with the rear end 128*b* of the retention rib 128. The contact body 132, and in particular the fingers 138, can deflect, flex, or otherwise deviate from their biased position as the contact body 132 rides along the retention rib 128. Thus, when the first and second contact members 112 and 114 are fully inserted into the connector housing 108, the first and second contact members 112 and 114 can define a bias force toward each other such that the first and second contact members 112 and 114 are frictionally clamped to the retention rib 128. The first and second beams 168 and 170 of the bias member 130 can further define the bias force toward each other such the first and second contact members 112 and 114 can be frictionally clamped to the retention rib 128. Thus, when the electrical connector 102 is mated with the electrically conductive component 104, the interior surfaces 112*a* and 114*a* of the first and second contact members 112 and 114, respectively, can define the bias force, which can be referred to as a mating force, along the lateral direction A so as to press the first and second contact members 112 and 114 against the electrically conductive component 104. Further, the first and second contact members 112 and 114 can define a mating gap 174 (see FIG. 8) that is configured to receive the electrically conductive component 104. It will be understood that the mating gap 174 can be sized as desired so as to receive components of varying widths. In one example, the maximum retention rib width 131 can define the size of the mating gap 174. Thus, the maximum retention rib width 131 can be sized so as to vary the mating gap 174 as necessary. For instance, the maximum retention rib width 131 can be configured so that the mating gap 174 is sized to receive and establish an electrical connection with the complementary electrically conductive component 104.

Referring to FIGS. 14-17B, it will be understood that one or more of the electrical connectors 102 can be alternatively arranged as desired. For instance, referring to FIG. 14, in accordance with one embodiment, an electrical connector assembly 100 can include a first electrical connector 102 and a second electrical connector 102. Thus, the electrical connector assembly 100 can include first and second ones of the electrical connector 102. The electrical connector assembly 100 can further include a guide member 103 that is disposed between the first and second ones of the electrical connectors 102 along the lateral direction A. While the illustrated electrical connector assembly 100 includes two electrical connectors 102 and one guide member 103, it will be understood that the electrical connector assembly 100 can include any number of electrical connectors and guide members as desired. For example, the electrical connector assembly 100 can be configured to be mated with at least one, for instance two, complementary electrically conductive components 104, which can be configured as a printed circuit board or an electrical conductor such as a bus bar or power rail. The electrical connector assembly 100 can be mated with the complementary electrically conductive components 104 along the mating direction M so as to establish an electrical connection, for instance an electrical connection that transfers electrical power, between the electrical connector assembly 100 and the electrically conductive component 104.

In one example, at least one of the electrical connectors 102 of the electrical connector assembly 100 can be a power connector and at least one of the electrically conductive components 104 can be configured as a power rail. Thus, the guide member 103 of the electrical connector assembly 100 can be configured to be inserted between first and second power rails, such that at least one of the contact members 112 and 114 of the first electrical connector 102 contacts the first power rail, and at least one of the first and second contact members 112 and 114 of the second electrical connector 102 contacts the second power rail The electrical connector assembly 102 can be configured to be mounted to a substrate 106*a* and the complementary electrically conductive component 104 can be configured to be mounted to a substrate so as to establish an electrical connection between the substrate 106*a* and the substrate to which the complementary electrically conductive component 104 is mounted. The substrate 106*a* can be provided as a backplane, midplane, daughtercard, or the like.

With continuing reference to FIGS. 14-17B, the guide member 103 can include a dielectric or electrically insulative guide member body 105. In accordance with the illustrated embodiment, the guide member body 105 defines a front end 105*a* and an opposed rear end 105*b* that is spaced from the front end 105*a* along the longitudinal direction L. The front end 105*a* can generally lie in a plane defined by the transverse and lateral directions T and A, respectively. The front end 105*a* can define the mating interface 118 that is configured to be mated with the electrically conductive component 104 as to place the electrical connector assembly 100 in electrical communication with the complementary electrically conductive component 104. The guide member body 105, and thus the guide member 103, can further include a top end 105*c* and an opposed bottom end 105*d* that is spaced from the top end 105*c* along the transverse direction T. For instance, the top end 105*c* can be spaced from the bottom end 105*d* in the upward direction that is substantially parallel to the transverse direction T. The top end 105*c* can extend from the front end 105*a* to the rear end 105*b*. The bottom end 105*d* can define the mounting interface 120 that is configured to be mounted to the substrate 106. The bottom end 105*d* can generally lie in a plane defined by the longitudinal and lateral directions L and A, respectively. The guide member body 105, and thus the guide member 103, can further include first and second opposed sides 105*e* and 105*f*, respectively, that are spaced from each other along the lateral direction A. While the lateral and longitudinal directions A and L, respectively, extend horizontally and the transverse direction T extends vertically in accordance with the illustrated orientation of the electrical connector assembly 100, it should be appreciated that the orientation of the electrical connector assembly can vary as desired.

It will be understood that the guide member 103 can be monolithic with the connector housing 108 of at least one, for instance both, of the first and second electrical connectors 102. Alternatively, the guide member 103 can be attached to at least one, for instance both, of the connector housings 108. The guide member 103 can be offset with respect to the front end 122*a* of the connector housing 108 along the lateral direction such that the guide member 103 can extend forward along the mating direction M with respect to the first and second electrical connectors 102 of the electrical connector assembly 100. The guide member 103 can include tapered edges 107 that extend outwardly along the rearward direction from the front end 105*a* toward the rear end 105*b*. As illustrated, the guide member 103 can define a first tapered edge 107 that terminates at the front end 122*a* of the connector housing 108 of the first electrical connector 102, and the guide member 103 can define a second tapered edge 107 that terminates at the front end 122*a* of the connector housing 108 of the second electrical connector 102. Thus, the guide member 103 can include tapered edges 107 that extend inwardly along the forward direction toward the front end 105*a* from the rear end 105*b*.

The guide member body 105 can define the tapered edges 107 such that the complementary electrically conductive components 104 can be guided by the tapered edges 107 toward the opening 124 of each of the electrical connectors 102 when the electrical connector assembly 100 is mated with the electrically conductive components 104.

The guide member 103 can define one or more mounting posts 109 that are configured to be mounted to the substrate 106*a*. The mounting posts 109 can be monolithic with the guide member body 105, or the mounting posts 109 can be attached to the guide member body 105 as desired. The mounting posts 109 can extend from the guide member body 105 downwardly along the transverse direction T. In accordance with the illustrated embodiment, the electrical connector assembly 100 includes two mounting posts 109, though it will be understood that the number of mounting posts 109 can vary as desired. The mounting post 109 can be received by apertures 111 of the substrate 106*a*. The mounting posts 109 can be configured to be received by the apertures 111 such that the electrical connector assembly 100 is secured to the substrate 106*a*, for instance, during soldering. The mounting posts 109 can be elongate along the transverse direction T.

In operation, a method of establishing an electrical connection with the electrical connector 102 that has 1) the connector housing 108 including the housing body 116 that defines the front end 122*a*, the opening 124 disposed at the front end 122*a*, the top end 122*c* that extends from the front end 122*a* to the rear end 122*b* that is spaced from the front end 122*a* along the longitudinal direction L, and the bottom end 122*d* spaced from the front end 122*a* along the transverse direction T that is substantially perpendicular with respect to the longitudinal direction L, wherein the bottom end 122*d* defines a mounting interface 120; and 2) at least one contact member supported by the connector housing 108, the at least one contact member including a contact body 132 that defines the mounting tail 146 and the mating end 132*a*, can include applying a mounting force to the connector housing 108 substantially along the transverse direction T. The method can further include transferring the mounting force from the connector housing 108 to a mounting tail 146 of the contact member at an interface at a location where the connector housing 108 abuts the contact body 132. At least a portion of the location can be aligned with the mounting tail 146 along the transverse direction T. The mounting tail 146 can define a press-fit tail, and the transferring step can further comprise the step of causing the press-fit tail to be press-fit into an aperture of the substrate 106.

A method of manufacturing the electrical connector 102 can include inserting at least one contact member, for instance the first contact member 112, into the interior void 148 of the connector housing 108 from the rear end 122*b* toward the front end 122*a* long the longitudinal direction such that the mating end 132*a* contacts the retention rib 128 that is supported by the connector housing 108. The method can further include causing at least one arm 136 of the at least one contact member to bear against the retention rib 128 so as to retain the at least one contact member with respect to the connector housing 108 such that the mating end 132*a* is disposed at the opening 124. The at least one contact member can be the first contact member 112, the electrical connector can further include the second contact member 114. Thus, the method can further include, causing the first and second contact members 112 and 114, respectively, to bear against opposed sides of the retention rib 128 so as to retain the first and second contact members 112 and 114 with respect to the connector housing 108.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, the invention is intended to encompass all modifications and alternative arrangements included within the spirit and scope of the invention, for instance as set forth by the appended claims.

What is claimed:

1. An electrical connector comprising:

a connector housing including a housing body that defines an opening configured to receive at least one complementary electrically conductive component along a mating direction, and a retention rib projecting from a top end and a bottom end of the housing body; and at least one contact member supported by the connector housing, the at least one contact member including a contact body that defines a mounting tail, a mating end and an intermediate portion disposed between the mounting tail and the mating end, wherein the intermediate portion of the at least one contact member bears against the retention rib so as to retain the at least one contact member with respect to the connector housing.

2. The electrical connector as recited in claim 1, wherein the electrical connector further comprises a bias member that engages the at least one contact member and biases the at least one contact member in a lateral direction perpendicular to the mating direction.

3. The electrical connector as recited in claim 2, wherein the mounting tail is configured to be mounted to a substrate, and the housing body and the at least one contact member defines a mounting force transfer interface defined at a location where the housing body abuts the at least one contact member, and the location is in alignment with the mounting tail along a transverse direction that is substantially perpendicular to both the mating and lateral directions.

4. The electrical connector as recited in claim 3, wherein the at least one contact member defines a mounting force transfer member that extends up from the contact body along the transverse direction, the mounting force transfer member configured to abut the housing body to define the mounting force transfer interface.

5. The electrical connector as recited in claim 3, wherein the housing body defines an interior void configured to receive the at least one contact member, and the connector housing comprises a mounting force transfer member that extends from the housing body into the interior void, the mounting force transfer member configured to abut the at least one contact member to define the mounting force transfer interface.

6. The electrical connector as recited in claim 2, wherein the at least one contact member is a first contact member, the electrical connector further comprising:

a second contact member spaced from the first contact member along the lateral direction, the second contact member supported by the connector housing and configured to contact the complementary electrically conductive component when the complementary electrically conductive component is received in the opening.

7. The electrical connector as recited in claim 6, wherein the retention rib defines a width along the lateral direction, the first and second contact members are spaced from each other at first and second locations positioned such that the retention rib is disposed between the first and second locations, and the first and second contact members are spaced from each other at each of the first and second locations a distance along the lateral direction that is less than a maximum width of the retention rib.

8. The electrical connector as recited in claim 7, wherein the width of the retention rib increases along the forward direction.

9. The electrical connector as recited in claim 6, wherein the bias member retains the first and second contact members in position relative to each other.

10. The electrical connector as recited in claim 6, wherein the second contact member includes a second arm having a second proximal portion, a second distal portion, and a second intermediate portion between the second proximal and distal portions, the second intermediate portion is spaced outward with respect to each of the second proximal and distal portions, and the second intermediate portion bears against the retention rib so as to retain the second contact member with respect to the connector housing.

11. The electrical connector as recited in claim 6, wherein each of the first and second contact members include a contact body including a first intermediate portion, an end portion that extends forward along the mating direction from the first intermediate portion, and the respective arm, wherein the arm extends forward along the mating direction from the first intermediate portion and is spaced from the end portion along the lateral direction.

12. The electrical connector as recited in claim 11, wherein the arm of the first contact member is opposite the arm of the second contact member along the lateral direction to define opposed arms that are configured to abut opposed sides of the complementary electrically conductive component when the complementary electrically conductive component is received in the opening.

13. The electrical connector as recited in claim 12, wherein the arms define a respective arm body and respective fingers that extend from the respective arm body in a forward direction.

14. The electrical connector as recited in claim 1, wherein the connector is a power connector.

15. The electrical connector as recited in claim 1, wherein the retention rib is monolithic with the housing body.

16. The electrical connector as recited in claim 1, wherein the retention rib is attached to the housing body.

17. An electrical connector assembly including first and second ones of the electrical connector as recited in claim 1, and a guide member disposed between the first and second ones of the electrical connector, the guide member configured to be inserted between first and second power rails, such that the at least one contact member of the first electrical connector contacts the first power rail, and the at least one of the second contact member of the second electrical connector contacts the second power rail.

18. An electrical connector configured to mate with at least one complementary electrically conductive component, and further configured to mount to a substrate, the electrical connector comprising:

a connector housing including a housing body that defines a front end, an opening disposed at the front end, a top end that extends from the front end to a rear end that is spaced from the front end along a longitudinal direction, and a bottom end spaced from the top end along a transverse direction that is substantially perpendicular with respect to the longitudinal direction, wherein the bottom end defines a mounting interface; and at least one contact member supported by the connector housing, the at least one contact member including a contact body that defines a mounting tail that is placed in electrical communication with the substrate when the at least one contact member is mounted to the substrate, the contact body further defining a mating end that electrically contacts the complementary electrically conductive component when the complementary electrically conductive component is received in the opening, wherein at least one of the connector housing and the at least one contact member defines a mounting force transfer interface defined at a location where the housing body abuts the at least one contact member, and at least a portion of the location is in alignment with the mounting tail along the transverse direction.

19. The electrical connector as recited in claim 18, wherein the mating end is adjacent the complementary electrically conductive component along a lateral direction that is perpendicular to both the longitudinal and the transverse directions.

20. The electrical connector as recited in claim 18, wherein the at least one contact member defines first and second arms that cooperate to define the mating end, the arms spaced from each other along a lateral that is perpendicular to both the longitudinal and the transverse directions.

21. The electrical connector as recited in claim 18, wherein an entirety of the location is in alignment with the mounting tail along the transverse direction.

22. The electrical connector as recited in claim 18, wherein the top end is spaced from the bottom end in an upward direction that is substantially parallel to the transverse direction, wherein the at least one contact member defines an uppermost surface and a mounting force transfer member that extends up from the uppermost surface along the transverse direction such that mounting force transfer member terminates at a location spaced from the uppermost surface along the upward direction.

23. The electrical connector as recited in claim 18, wherein the top end is spaced from the bottom end in an upward direction that is substantially parallel to the transverse direction, and wherein the housing body defines an interior void configured to receive the at least one contact member, and the connector housing comprises a mounting force transfer member that extends from the top end in a downward direction that is opposite the upward direction and into the interior void, the mounting force transfer member configured to abut the contact body to define the mounting force transfer interface.

24. The electrical connector as recited in claim 23, wherein the mounting force transfer member of the connector housing is configured to abut the mounting force transfer member of the at least one contact member, the mounting force transfer member of the at least one contact member extending up from an uppermost surface of the at least one contact member along the transverse direction such that mounting force transfer member terminates at a location spaced from the uppermost surface along the upward direction.

25. An electrical connector assembly including first and second ones of the electrical connector as recited in claim 1, and a guide member disposed between the first and second ones of the electrical connector, the guide member configured to be inserted between first and second power rails, such that the at least one contact member of the first electrical connector contacts the first power rail, and the at least one of the second contact member of the second electrical connector contacts the second power rail.

26. A method of manufacturing an electrical connector that has 1) a connector housing including a housing body that defines a front end, an opening disposed at the front end, a top end that extends from the front end to a rear end that is spaced from the front end along a longitudinal direction, and a bottom end spaced from the top end along a transverse direction that is substantially perpendicular with respect to the longitudinal direction, wherein the bottom end defines a mounting interface; and 2) at least one contact member supported by the connector housing, the at least one contact member including a contact body that defines a mounting tail and a mating end, the method comprising:

inserting the at least one contact member into an interior void of the connector housing from the rear end toward the front end along the longitudinal direction such that the mating end contacts a retention rib supported by the connector housing;

causing at least one arm of the at least one contact member to bear against the retention rib so as to retain the at least one contact member with respect to the connector housing such that the mating end is disposed at the opening.

27. The method of claim as recited in claim 26, wherein the at least one contact member is a first contact member, the electrical connector further including a second contact member, the method further comprising:

causing the first and second contact members to bear against opposed sides of the retention rib so as to retain the first and second contact members with respect to the connector housing.

* * * * *